United States Patent [19]

Gross

[11] Patent Number: 4,496,106

[45] Date of Patent: Jan. 29, 1985

[54] AGITATOR-GRINDER

[75] Inventor: Horst Gross, Lampertheim, Fed. Rep. of Germany

[73] Assignee: Draiswerke GmbH, Mannheim, Fed. Rep. of Germany

[21] Appl. No.: 346,365

[22] Filed: Feb. 5, 1982

[30] Foreign Application Priority Data

Feb. 19, 1981 [DE] Fed. Rep. of Germany ..... 3106062

[51] Int. Cl.[3] ..... B02C 17/16

[52] U.S. Cl. ..... 241/46.17; 41/79; 41/171; 41/172; 41/179

[58] Field of Search ..... 241/46.17, 46.11, 46.02, 241/46.04, 171, 172, 80, 97, 69, 284, 79

[56] References Cited

U.S. PATENT DOCUMENTS

| | | | |
|---|---|---|---|
| 281,511 | 7/1883 | Howland | 241/284 X |
| 2,398,989 | 4/1946 | Agthe | 241/80 X |
| 2,595,117 | 4/1952 | Ahlmann | 241/172 X |
| 3,311,310 | 3/1967 | Engels et al. | 241/172 X |
| 4,349,158 | 9/1982 | Broman | 241/46.04 X |

FOREIGN PATENT DOCUMENTS

| | | |
|---|---|---|
| 1184188 | 12/1964 | Fed. Rep. of Germany . |
| 1507504 | 4/1971 | Fed. Rep. of Germany . |
| 2811899 | 9/1979 | Fed. Rep. of Germany . |
| 2016953 | 10/1979 | United Kingdom . |

*Primary Examiner*—Mark Rosenbaum

*Attorney, Agent, or Firm*—Browdy and Neimark

[57] ABSTRACT

An agitator-grinder comprises a grinding vessel (3) and an agitator mechanism disposed in the grinding vessel (3) and drivable at high speed, between which agitator mechanism and the wall of the grinding vessel there is a grinding chamber partially filled with auxiliary grinding bodies. A grinding stock inflow conduit (20) discharges into the grinding chamber at one end, and a separator device (25) for separating the ground stock from the auxiliary grinding bodies (24) is provided at the other end. In order to enable the recirculation of the auxiliary grinding bodies (24) in a simple manner and in particular also to enable the exertion of influence on the return flow, a return flow conduit (34) is directed out of the grinding chamber (annular-cylindrical chamber 23) in the vicinity of the separator device (25) back into the vicinity of the grinding stock inflow conduit (20), being attached to the grinding vessel (3) in a stationary manner, and the free cross section of the return flow conduit (34) is variable.

10 Claims, 2 Drawing Figures

AGITATOR-GRINDER

FIELD OF THE INVENTION

The invention relates to an agitator-grinder with a high-speed agitator mechanism disposed in the grinder vessel. The grinding chamber is an annular cylinder partially filled with auxiliary grinding bodies, with an inflow conduit at one end for the grinding stock and a separator device at the other end to separate the ground stock from the auxiliary grinding bodies.

BACKGROUND OF THE INVENTION

An agitator-grinder of this general kind, having an annular-cylindrical grinding chamber located between an agitator mechanism on one side, embodied by an agitator shaft with a hollow, cylindrical body, and the inner wall of the grinder vessel on the other is already known from German examined application DE-AS No. 11 84 188. Narrow annular-cylindrical grinding chambers of this kind, with a gap width of approximately 5 to 15 mm, have the advantage that the individual particles of a grinding stock in suspension or dispersion are very uniformly exposed to grinding and shear forces, so that there is a very small variation in the fineness of grinding. Because the radial extension of the grinding chamber per se is quite small, the auxiliary grinding bodies tend to back up at the separator because a sufficient return flow is not assured, although during the grinding process the auxiliary grinding bodies are capable of moving freely within the flow of auxiliary grinding bodies and auxiliary grinding stock taking place in the annular-cylindrical grinding chamber.

In order to attain a recirculation of the auxiliary grinding bodies back from the outlet for the ground stock, or in other words from the vicinity of the separator device, it is already known from British Pat. No. 2,016,953, relating to an agitator-grinder having an agitator mechanism which is embodied by discs on an agitator shaft, to make holes in these discs which have a radial component, so that the auxiliary grinding bodies entering such a hole in a disc from the top will be accelerated in their downward movement, thus creating a kind of return flow conduit.

An agitator-grinder having a means of recirculating auxiliary grinding bodies is known from German laid-open applications DE-OS No. 28 11 899. This apparatus functions on the same principle; that is, one or more return flow conduits having a radial directional component are provided in the agitator mechanism.

This known principle of returning auxiliary grinding bodies has the disadvantage that it is impossible to exert influence on the recirculation of the auxiliary grinding bodies, because their recirculation is effected by means of the agitator mechanism, which is drivable at high speed and, in the case of a closed agitator-grinder, is practically inaccessible.

SUMMARY OF THE INVENTION

It is accordingly an object of the invention to improve an agitator-grinder of this general type in such a way as to enable the recirculation of the auxiliary grinding bodies in a simple manner and in particular so as to make it possible to influence the return flow.

This object is attained in accordance with the invention by providing that a return flow conduit leads from the grinding chamber in the vicinity of the separator device back to the vicinity of the inflow conduit for grinding stock; the return conduit is attached to the grinding vessel in a stationary manner.

By recirculating the auxiliary grinding bodies through the return flow conduit embodied in the grinding vessel, this return flow is effected in a structurally very simple manner. Since the return flow conduit is located on the grinding vessel, it is very simple to provide an observation window through which optical monitoring can be performed. Circulation of the grinding stock also takes place through this conduit, preferably for the particles of material which have not yet been ground finely enough. The reason for this is that both the auxiliary grinding bodies and the insufficiently well ground portion of the grinding stock are recirculated by the centrifugal action of the agitator mechanism. Because the return flow conduit discharges into the inflow conduit for the grinding stock, suction is created, thus further reinforcing the centrifugal effect. Furthermore, the grinding stock and the auxiliary grinding bodies undergo good pre-mixing in the grinding stock inflow conduit.

A great advantage of the device according to the invention is that it becomes possible to vary the cross section of the return flow conduit. By this means, it is possible to optimize the specifications of the agitator-grinder, such as for maximal exploitation of energy or in other words for high efficiency. The variability of the return flow conduit cross section also makes it possible to influence the recirculation of auxiliary grinding bodies in accordance with pressure, viscosity, temperature and auxiliary grinding body size, which means in turn that optimal influence can be exerted on the desired fineness of the ground stock.

The invention further provides advantages in terms of the character of the return flow conduit and the adjustability of its free cross section. The adjustability of the free return flow conduit cross section can be regulated in accordance with operating characteristics of the agitator-grinder, such as the power required by the drive motor.

The suction which reinforces the centrifugal effect is increased further because of the enlargement of the mouth of the grinding stock inflow conduit provided by the invention.

Further advantages and characteristics of the invention will become apparent from the ensuing description of an exemplary embodiment, taken in conjunction with the drawings.

DESCRIPTION OF THE PREFERRED EMBODIMENT

Figure 1:
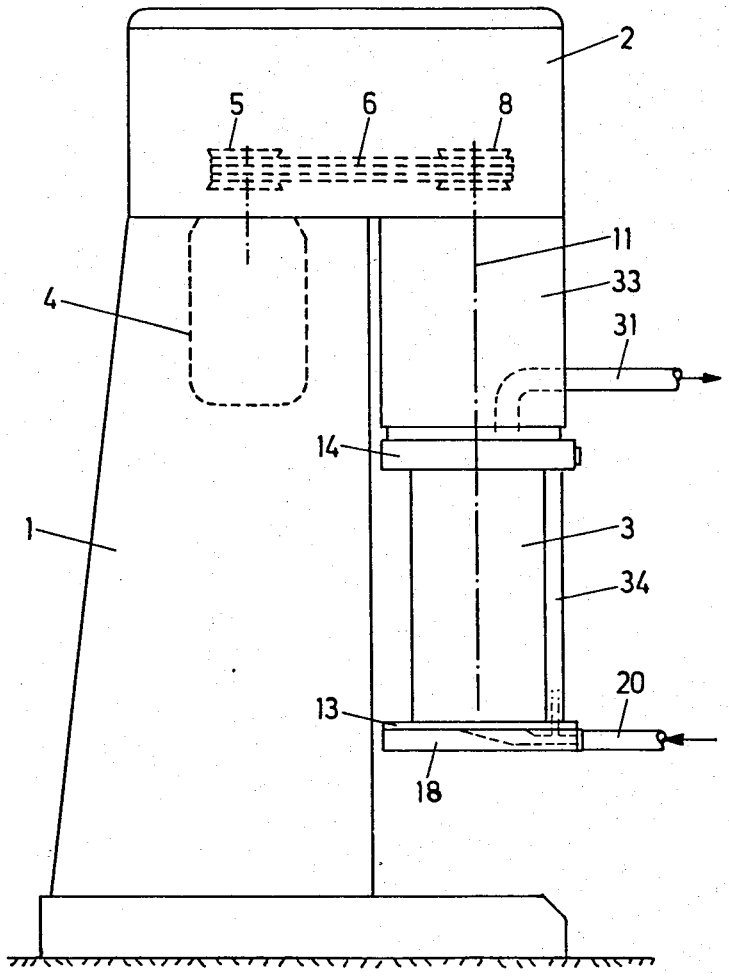
FIG. 1 shows an agitator-grinder in accordance with the invention.

The agitator-grinder shown in the drawing has a stand 1 in the conventional manner, on the upper part of which is attached a protruding support arm 2, to which a cylindrical grinding vessel 3 is secured in turn. An electric drive motor 4 is housed in the stand 1 and is provided with a V-belt pulley 5, by which a V-belt pulley 8 is rotatably drivable via V-belts 6. The V-belt pulley 8 is connected with an agitator shaft 7 in a rotationally fixed manner.

The grinding vessel 3 has a cooling jacket 9, which is defined by a cylindrical inner wall 10 and a likewise cylindrical outer wall 12, both walls being disposed concentrically relative to the central longitudinal axis 11 of the grinding vessel. The inner wall 10 and the outer wall 12 are connected to one another at the top and at the bottom by annular flanges 13, 14. A coolant connection 15 discharges into this cooling jacket 9 at the bottom, and a coolant outlet 16 leaves the jacket 9 at the top. A pipeline 17 coiled in helical fashion is disposed in the cooling jacket and rests on the inner wall 10 and the outer wall 12. In the chamber portions of the cooling jacket 9 located among the coils of the pipeline 17, the coolant is guided along a helical course from bottom to top, which improves the cooling effect. On the other hand, the pipeline 17 itself may serve to carry a heat-transmission medium, for instance a heating medium.

The grinding vessel 3 is closed off at its lower end by a base plate 18, which is attached to the lower flange 13 by screws 19, for example. A grinding stock inflow conduit 20 is provided in the base plate 18, discharging approximately concentrically into the inner chamber 21 of the grinding vessel 3, and grinding stock can be pumped from the bottom into this inner chamber 21 through such inflow conduit 20.

A cylindrical hollow body 22 which is closed at either end is concentrically attached to the agitator shaft 7, itself disposed concentrically to the longitudinal axis 11; together with the agitator shaft 7, the hollow body 22 comprises an agitator mechanism. A narrow annular-cylindrical chamber 23 is defined between the hollow body 22 and the cylindrical inner wall 10 of the grinding vessel 3, forming the grinding chamber per se. The radial width b of this annular-cylindrical chamber 23 is approximately 5 to 10 mm.

The inner chamber 21 of the grinding vessel 3, to the extent that it is not occupied by the hollow body 22, is filled up to from 70 to 80% of its volume with auxiliary grinding bodies 24. The diameter d of the grinding bodies 24 is 0.1 to 3 mm. The ratio of the gap width of the annular-cylindrical chamber 23 to the diameter of the auxiliary grinding bodies 24 is expressed as b/d = from 5 to 20.

At the upper end, the inner chamber 21 of the grinding vessel 3 is closed off by a separator device 25. This separator device substantially comprises a ring 26, which is connected with the hollow body 22 and thus rotates along with the agitator mechanism, and an opposed ring 27 firmly connected to the grinding vessel 3. The two rings 26 and 27 overlap one another radially but are disposed spaced apart slightly from one another axially, forming a separator gap 28, whose width—determined by the axial distance between the ring 26 and the opposed ring 27—is smaller than the smallest diameter d of the auxiliary grinding bodies 24 being used. This separator gap 28 discharges into a discharge chamber 29, formed between the stationary opposed ring 27 and a lid 30 of the grinding vessel 3.

A ground stock outlet line 31 for discharging the finished ground product empties out of this discharge chamber 29. The separator device 25 is known, for instance from U.S. Pat. No. 3,311,310. The lid 30 is secured together with the opposed ring 27 to the upper flange 14 of the grinding vessel 3 in a releasable manner via screws 32. The lid 30 itself is attached in turn to a holder device 33, which is attached to the underside of the support arm 2, so that the grinding vessel 3 can be flanged onto the assembly from the bottom in the conventional manner.

A tubular return flow conduit 34 for ground stock and auxiliary grinding bodies 24 is attached to the outside of the outer wall 12 and discharges at the bottom into the grinding stock inflow conduit 20. At its upper part, the return flow conduit 34 is attached to the upper end of the annular-cylindrical chamber 23 via a return flow fitting which extends approximately radially relative to the longitudinal axis 11. The inlet opening 36 of the fitting 35 is thus just barely covered by the cylindrical hollow body 22.

Figure 2:
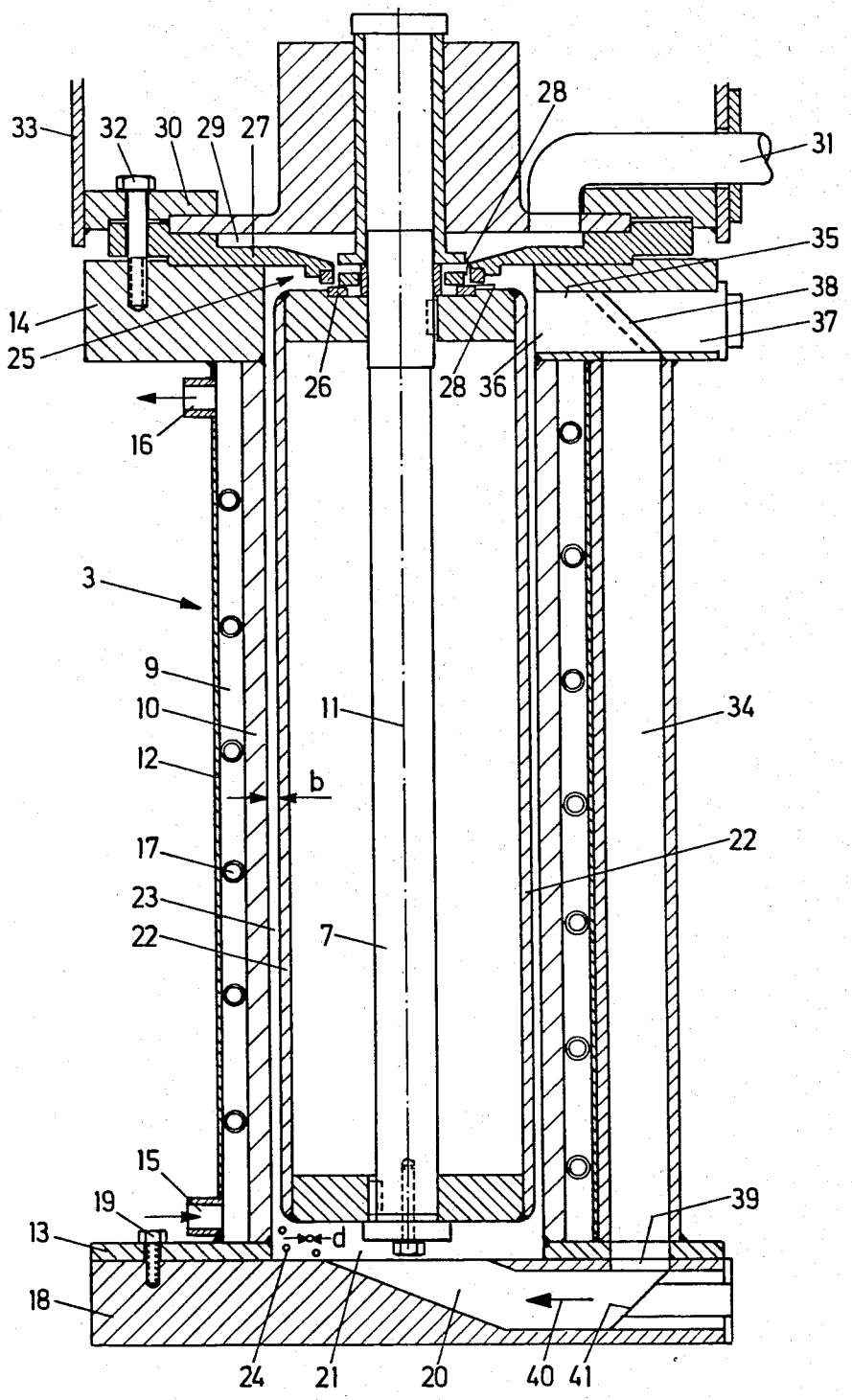
FIG. 2 shows the grinding vessel of the agitator-grinder, seen in a longitudinal section.

The free cross section of the fitting 35 or the conduit 34 is variable. This is attained in the embodiment shown in FIG. 2 by the introduction of an adjusting element 37, in the form of a displaceable piston, into the fitting 35 from the outside. The adjusting element 37 can be introduced into the fitting 35 to various insertion depths, so that the inlet into the return flow conduit can be either fully opened or partially covered. This piston-like adjusting element is provided with a deflector face 38, which deflects the ground product and in particular the grinding bodies on their course from the fitting 35 into the conduit 34 without using a significant amount of energy. In FIG. 2, a position of the adjusting element 37 is indicated by broken lines in which the free inlet cross section of the return flow conduit 34 has been approximately half closed.

The apparatus functions as follows:

The free interior of the grinding vessel 3 is, as noted above, from 70 to 80% filled with auxiliary grinding bodies 24. The agitator shaft 7 and thus the hollow body 22 are driven at high speed by the drive motor 4, that is, at a peripheral speed of the hollow body 22 of 5 to 40 m/sec, for example. Grinding stock is forced upward through the grinding stock inflow conduit 20 into the inner chamber 21 by means of a pump. The grinding product, together with the auxiliary grinding bodies 24, moves upward through the annular-cylindrical chamber 23, which is the actual grinding chamber, and the auxiliary grinding bodies 24 are exposed to rotary pulses by the hollow body 22. These rotary pulses cause intensive movement on the part of the auxiliary grinding bodies 24 within the grinding stock, thus in a known manner attaining a pulverizing and dispersing effect. Once the auxiliary grinding bodies 24 attain the level of the inlet opening 36 of the return flow fitting 35, at least most of them are forced by centrifugal force into the return flow fitting so that they pass through the fitting and through the return flow conduit 34, from whence they again pass into the grinding stock inflow conduit 20. Here, they undergo intensive intermixing with the grinding stock pumped into the conduit 20, so that they are already relatively uniformly distributed in the grinding stock at their entrance into the inner chamber 21 of the grinding vessel 3.

Naturally, grinding stock is also recirculated through the return flow fitting 35 and the return flow conduit 34 and again subjected to the grinding and dispersing process. This material is substantially grinding stock which has not yet been ground sufficiently finely and has therefore not yet passed through the separator device 25 and out of the grinding vessel. Because of the strong centrifugal forces acting on the particles of grinding stock, the larger particles—that is, those which have not yet been ground finely enough—are spun toward the area of the wall with greater force and thus have a greater tendency to pass into the return flow fitting 35.

Because suction is exerted on the return flow conduit 34 from the grinding stock inflow conduit 20, the centrifugal effect at the inlet opening 36 of the fitting 35 is still further reinforced. This suction is reinforced further in turn because there is an enlargement in the grinding stock inflow conduit 20 at the mouth 39 of the conduit 34 into the conduit 20, the enlargement increasing in the direction 40 in which the stock is pumped in. A further feature at this point is a partial deflector face 41, whose purpose is to keep the flow losses as low as possible as the grinding bodies are being transported.

It is to be understood that the foregoing text and drawing relate to an embodiment of the invention which is given by way of example but not limitation. Various other embodiments and variants are possible within the spirit and scope of the invention.

What is claimed is:

1. An agitator-grinder for performing wet-grinding of stock material comprising:

a grinding vessel having an agitator mechanism comprising a cylindrical hollow body disposed in the grinding vessel and drivable at high speed, a narrow annular-cylindrical chamber partially filled with auxiliary grinding bodies defining a grinding chamber between said agitator mechanism and a wall of the grinding vessel, the inner walls of said grinding chamber being of complementary cylindrical shape and forming therebetween a gap of from 5 mm to 10 mm width, the ratio of gap width b to grinding body diameter d being about 5 to 20, and the speed of the agitator mechanism at its periphery being froms 5 to 40 m/sec, a grinding stock inflow conduit discharging into said grinding chamber at one end and a separating device at the other end thereof for separating ground stock from the auxiliary grinding bodies, a return flow conduit extending from said grinding chamber in the vicinity of said separator device back into the vicinity of said grinding stock inflow conduit, said conduit being attached in a stationary manner to said grinding vessel, and including means for varying the cross-section of a portion of said return flow conduit.

2. An agitator-grinder as defined by claim 1, wherein said return flow conduit is directed back into the grinding stock inflow conduit.

3. An agitator-grinder as defined by claim 2, wherein said grinding stock inflow conduit has an enlargement at the mouth of said return flow conduit, extending in the direction in which the grinding stock is supplied.

4. An agitator-grinder as defined by claim 3, further comprising a deflector in said inflow conduit opposite the mouth of said return flow conduit.

5. An agitator-grinder as defined by claim 1, wherein said return flow conduit discharges approximately in a radial plane from said grinding chamber via a return flow fitting.

6. An agitator-grinder as defined by claim 1, wherein said varying means comprises a displaceable adjusting element is disposed in the return flow conduit.

7. An agitator-grinder as defined by claim 6, wherein said adjusting element is disposed in said return flow fitting.

8. An agitator-grinder as defined by claim 6, wherein a deflector face is embodied on said adjusting element.

9. An agitator-grinder as defined by claim 1, wherein said return flow conduit comprises an inlet and an outlet, said inlet being located downstream of said separator device.

10. An agitator-grinder as defined by claim 1, wherein said return flow conduit includes an inlet and an outlet, said inlet comprising said portion.

* * * * *